US008814500B1

(12) United States Patent
Liang

(10) Patent No.: US 8,814,500 B1
(45) Date of Patent: Aug. 26, 2014

(54) TURBINE AIRFOIL WITH SHAPED FILM COOLING HOLE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 585 days.

(21) Appl. No.: 13/162,910

(22) Filed: Jun. 17, 2011

(51) Int. Cl.
*F01D 5/08* (2006.01)

(52) U.S. Cl.
USPC ..... 415/115; 416/97 R

(58) Field of Classification Search
USPC ..... 415/115; 416/97 R, 229 A, 229 R; 29/889.721
See application file for complete search history.

(56) References Cited

U.S. PATENT DOCUMENTS

| | | | | |
|---|---|---|---|---|
| 4,676,719 | A * | 6/1987 | Auxier et al. | 416/97 R |
| 4,992,025 | A * | 2/1991 | Stroud et al. | 416/97 R |
| 2004/0094524 | A1 * | 5/2004 | Stevens | 219/121.71 |

* cited by examiner

*Primary Examiner* — Edward Look
*Assistant Examiner* — Juan G Flores
(74) *Attorney, Agent, or Firm* — John Ryznic

(57) ABSTRACT

A film cooling hole for a turbine airfoil, the film hole having a metering inlet section followed by a diffusion section that has two sidewalls with a sinusoidal shape and with the upstream and downstream walls forming zero diffusion so that a thin slot is formed on the film hole opening. The film hole can be straight or curved in a direction of the film injection.

4 Claims, 9 Drawing Sheets

TURBINE AIRFOIL WITH SHAPED FILM COOLING HOLE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine airfoil with shaped film cooling holes.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Airfoils in stator vanes and rotor blades make use of film cooling holes to discharge a layer of film cooling air onto the external surface of the airfoil to form an insulation layer of cooler air against the hot gas stream passing over the airfoil surface and to keep the airfoil surface at or below a certain allowable metal temperature. Earlier film cooling holes were straight and at a constant diameter. More recent film cooling holes are shaped with a diffusion opening that produces greater film coverage. Straight film cooling holes pass straight though the airfoil wall at a constant diameter and exit at an angle to the airfoil surface. FIGS. 1-7 show prior art straight film holes. Some of the cooling air is ejected directly into the mainstream gas flow and causes turbulence, coolant dilution and a loss of downstream film effectiveness. Straight film holes form an opening on the airfoil surface (referred to as the hole breakout) in al elliptical shape that will induce a high stress issue on the airfoil surface.

FIG. 8 shows a prior art shaped film cooling hole with a diffusion section formed downstream from an inlet metering section. The FIG. 8 shaped film hole is referred to as a 10×10×10 film hole because the diffusion section has a 10 degree slope on each of the two side walls and the one downstream wall. The upstream wall does not slope and thus provides no diffusion to the film hole. During engine operation, hot gas is frequently captured within an upper corner of the film hole opening (#11 in FIG. 1) and causes shear mixing with the cooling air flowing through from the film hole. This causes a reduction of film cooling effectiveness for the film cooling hole. Also, internal flow separation occurs within the diffusion section of the film hole (#12 in FIG. 10) at a junction between the constant diameter metering section and the diffusion section.

BRIEF SUMMARY OF THE INVENTION

A turbine airfoil with a film cooling hole having a diffusion section with sinusoidal shaped side walls that open into an opening on the airfoil surface that has a thin slot shape with a short height and a large width to form a thin diffusion section. this thin diffusion shape with slot opening will allow radial diffusion of the streamwise oriented flow and combine the best aspects of both radial and streamwise straight film holes.

The shaped film cooling hole with the sinusoidal shaped side walls can also be curved in a direction of the mainstream gas flow in order to decrease an injection angle of the film hole.

DETAILED DESCRIPTION OF THE INVENTION

Figure 1:
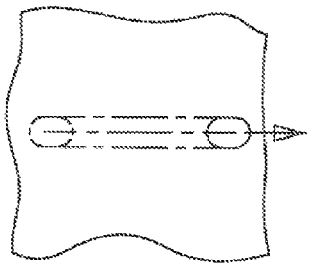
FIG 1 prior art
FIG. 1-3 show various prior art straight film cooling holes with different directions of discharge.
Figure 2:
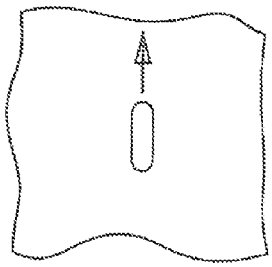
FIG 2 prior art
Figure 3:
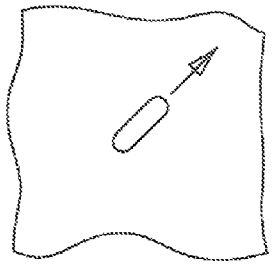
FIG 3 prior art
Figure 4:
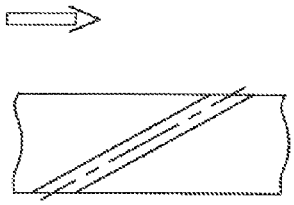
FIG 4 prior art
FIGS. 4-6 shows cross section side views of the straight film holes of FIGS. 1-3.
Figure 5:
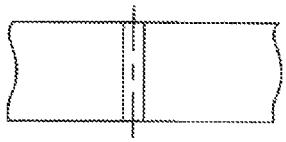
FIG 5 prior art
Figure 6:
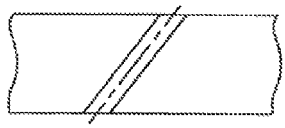
FIG 6 prior art
Figure 7:
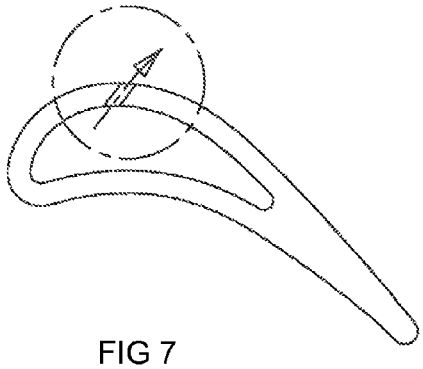
FIG 7 prior art
FIG. 7 shows a prior art turbine blade with a straight film cooling hole on the suction side wall.
Figure 8:
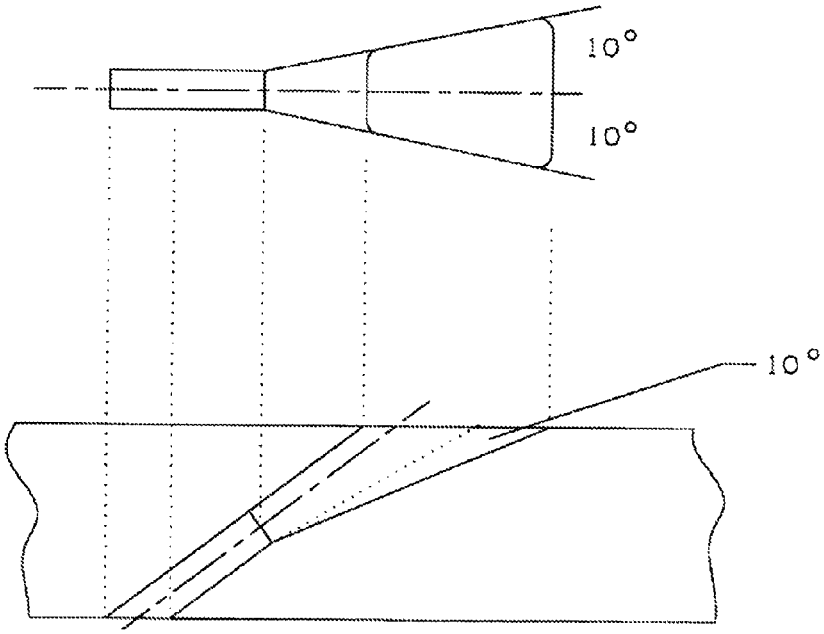
FIG 8 prior art
FIG. 8 shows a prior art shaped film cooling hole with a 10×10×10 diffusion section.
Figure 9:
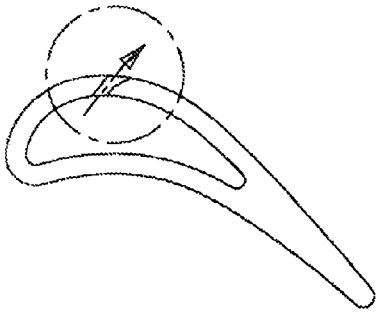
FIG 9 prior art
FIG. 9 shows a prior art turbine blade with a shaped film cooling hole on the suction side wall.
Figure 10:
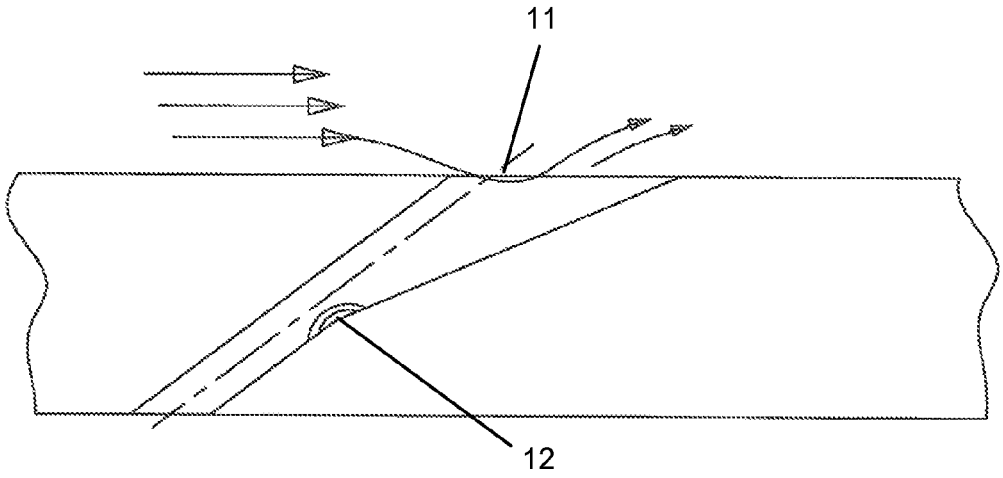
FIG 10 prior art
FIG. 10 shows a cross section view of the prior art shaped film cooling hole of FIG. 8 with the hot gas ingestion zone and the flow separation zone issues.
Figure 11:
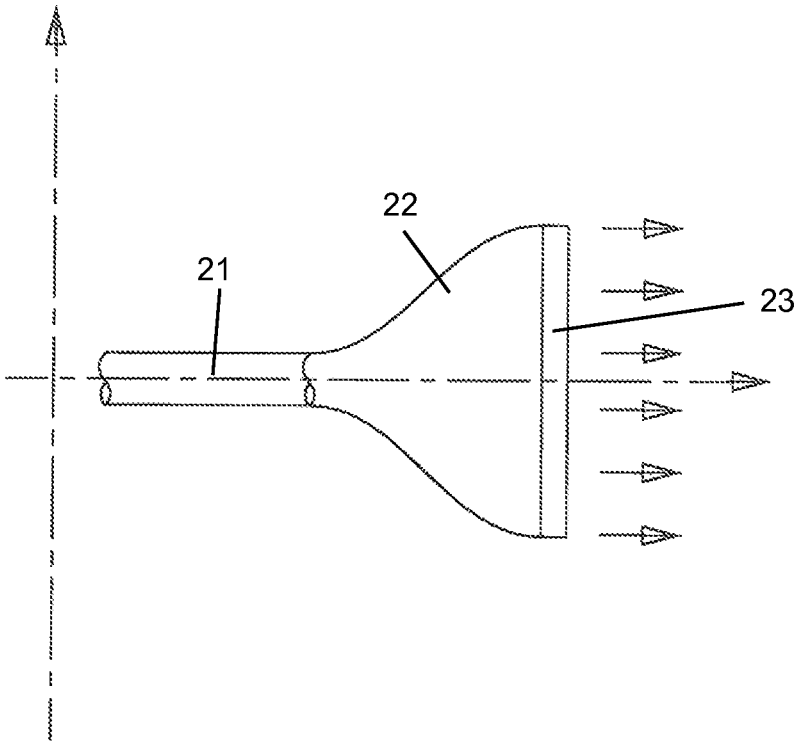
FIG. 11 shows a cross section top view of the film cooling hole of the present invention with the sinusoidal shaped side walls and the thin but wide slot opening.

A film cooling hole used in a turbine airfoil such as a rotor blade or a stator vane to provide for a layer of film cooling air onto the external airfoil surface. The film cooling hole includes an inlet metering section 11 having a constant diameter or cross sectional flow area flowed by a diffusion section 22 having two side walls with a sinusoidal shape as seen in FIG. 11. The top and bottom walls (also referred to as the upstream and the downstream walls) are parallel to the film hole axis and thus produce no diffusion. The upstream wall and the downstream wall are parallel to each other within the diffusion section of the film hole. The two sinusoidal shaped side walls and the two parallel upstream and downstream walls form an opening 23 having an elongated slot shape which is tall but narrow when observed in a plane of the two side walls. The FIG. 11 film hole is parallel to the streamwise direction. The sinusoidal shaped side walls end at the slot shaped opening with the walls also being parallel to the mainstream direction.

Figure 12:
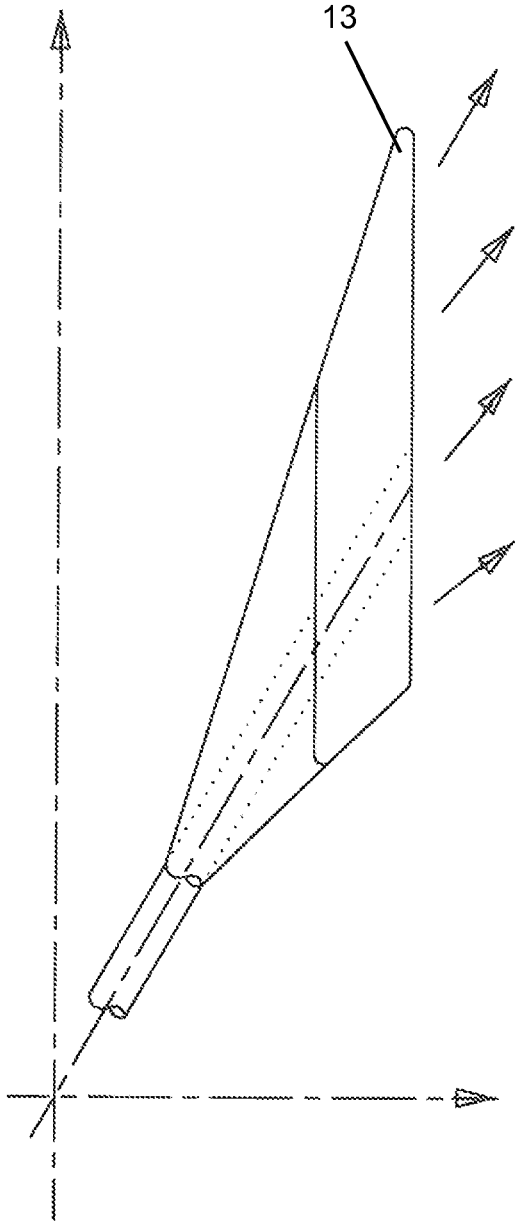
FIG 12 prior art
FIG. 12 shows a prior art shaped film hole with a 10×10×10 diffusion section oriented in a compound angle.

The film cooling hole of FIG. 11 has a diffusion section that is divergent only in the spanwise direction. This creates diffusion in the streamwise flow direction and increases the width of the breakout of the film hole and spreads out the cooling air onto the airfoil surface much more than the prior art film hole in FIG. 12. This provides for a better film coverage on the airfoil surface and higher film effectiveness. Also, a maximum breakout area to film hole breakout spanwise length is achieved. Maximum film coverage per blade span height is obtained.

Figure 13:
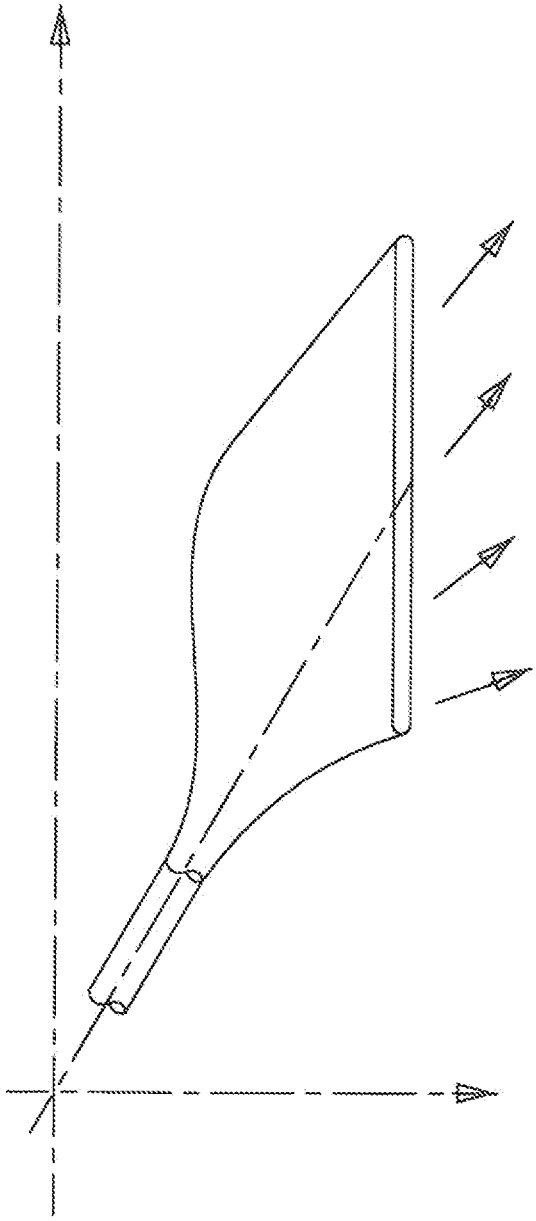
FIG. 13 shows the film cooling hole of the present invention in a compound orientation.

FIG. 13 shows the film cooling hole of the present invention in a compound orientation. The FIG. 13 film hole will eliminate the film cooling hole over-expansion in the radial direction that is found in the prior art compound film cooling hole shown in FIG. 12 and represented as reference numeral 13.

Figure 14:
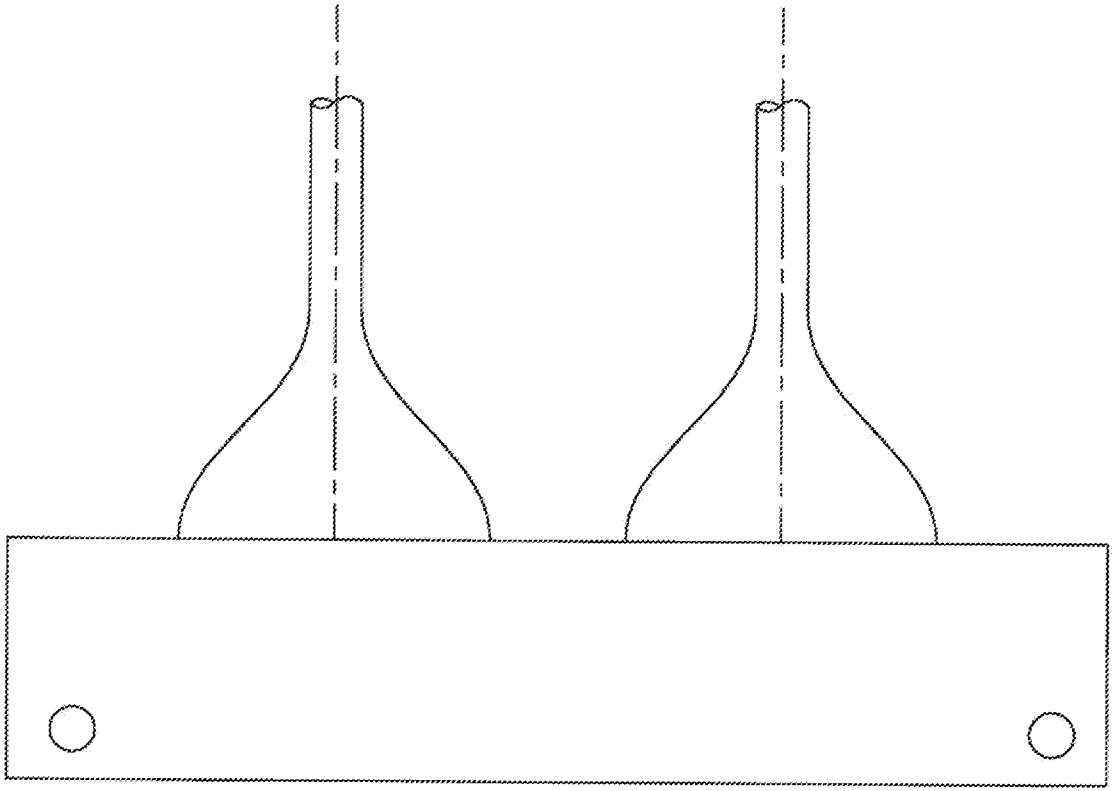
FIG. 14 shows a top view of an electrode used to form the film cooling hole of the present invention.
Figure 15:
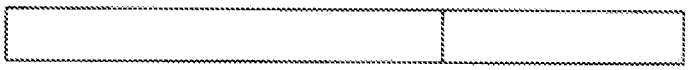
FIG. 15 shows a side view of the electrode of FIG. 14.
Figure 16:
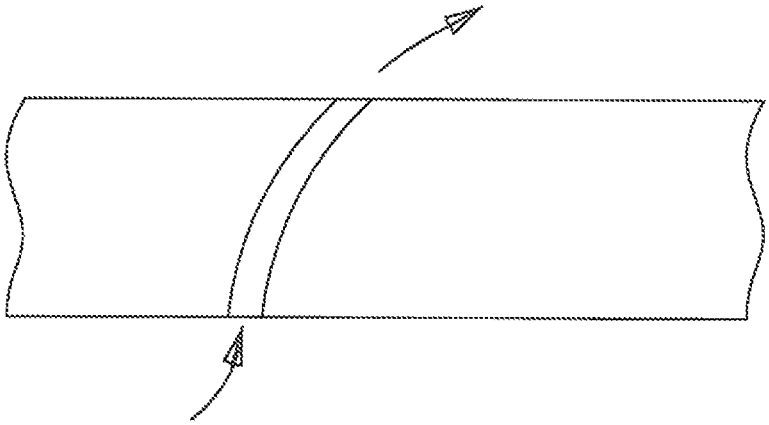
FIG. 16 shows a cross section side view of the film cooling hole of the present invention but with a curvature toward the mainstream gas flow.
Figure 17:
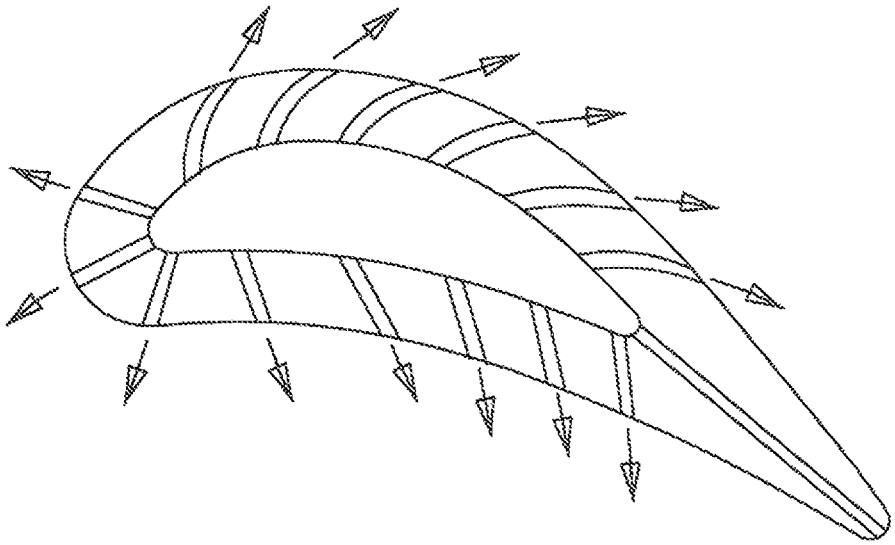
FIG. 17 shows a turbine blade with an arrangement of straight and curved film cooling holes with the sinusoidal shaped side walls of the present invention.

FIG. 14 shows a 2-dimensional electrode used to form the film cooling holes of the present invention. The electrodes extend from a comb. In this embodiment, 2 electrodes extend from a single comb. FIG. 15 shows a side view of the electrode and comb. To form a curved film cooling hole as seen in FIG. 16, the electrodes will have a curvature equal to the curvature of the curved film cooling hole. in the turbine blade shown in FIG. 17, both straight and curved film cooling holes having the sinusoidal shaped side walls that open into a thin but wide opening are used around the airfoil to discharge film cooling air. Straight film holes or slots are found on the leading edge and the pressure side wall while curved film holes or slots are used on the suction side wall.

The problems identified with the prior art film cooling hole can be eliminated with the use of the film cooling hole of the present invention having the sinusoidal shaped side walls and the long and narrow slot to produce a thin diffusion that will allow radial diffusion of the streamwise oriented flow and combine the best aspects of both radial and streamwise straight film holes.

The thin diffusion shaped film cooling slot includes a parallel flow section at a constant cross sectional area for the entrance region followed by a divergent section with the sinusoidal shaped side walls. The upstream and downstream walls remain parallel to that no diffusion is formed along these two walls of the film hole. The divergent shaped sidewalls then turn into convergent sidewalls in the sinusoidal shaped sidewalls. An elongated slot is formed at the opening for the film cooling slot in a spanwise direction. This transforms the cooling slot from a conical entrance section into a thin elongated slot at the exit end of the film hole on the airfoil surface.

In addition to the parallel upstream and downstream walls, the side walls of the thin metering diffusion film cooling slot is divergent only in the spanwise direction. The sinusoidal shaped side walls create diffusion in the streamwise flow direction and forms the elongated slot opening on the airfoil surface. The film cooling hole thus enhances the spreading out of the cooling flow on the airfoil surface to produce improved film coverage and higher film effectiveness than in the prior art film hole. A maximum breakout area to film hole breakout spanwise length is achieved so that a maximum film coverage per blade span height is obtained.

The thin slot in the film cooling hole of the present invention allows for ejection of the cooling air as a much lower injection angle. This minimizes shear mixing between the cooling flow layers versus the hot gas stream and therefore maintains a longer film sub-layer for a longer and better film cooling at a higher effective level on the airfoil surface. Also, the thin slot on the airfoil surface eliminates the hot gas entrainment issue and the convergent for the downstream wall to eliminate the internal flow separation issue found in the prior art film hole. since the exit plan for the side walls for the thin slot are parallel, the thin diffusion slot can be used in a compounded orientation without the film cooling over-expansion issue in the radial direction found in the prior art 10×10×10 expansion film cooling hole.

The film cooling hole with the sinusoidal shaped side walls and the parallel upper and lower walls that open into the thin slot will contain the expansion in the radial direction and parallel to the streamwise direction. Hot gas ingestion and internal separation in the prior art film cooling hole is eliminated. Also, coolant penetration into the gas path is minimized, yielding a good build-up of the coolant sub-boundary layer next to the airfoil surface, lower aerodynamic mixing losses occur due to the low angle of cooling air injection, a better film coverage in the spanwise direction and a high film effectiveness for a longer distance downstream from the film hole slot occurs. The end results of both benefits produce a better film cooling effectiveness level for the turbine airfoil.

I claim the following:

1. A film cooling hole for a turbine airfoil comprising:

an inlet section having a constant cross sectional flow area;

a diffusion section located downstream from the inlet section;

the diffusion section having two side walls and an upstream wall and a downstream wall;

the two side walls having a sinusoidal shape to produce a diffusion;

the upstream wall and the downstream wall both having zero diffusion; and, a thin slot forming an opening of the film hole on a turbine airfoil surface.

2. The film cooling hole of claim 1, and further comprising:

the diffusion section includes a diverging section followed by a converging section that opens into the thin slot.

3. The film cooling hole of claim 1, and further comprising:

the upstream and downstream walls are parallel to a central axis of the inlet section.

4. The film cooling hole of claim 1, and further comprising:

the upstream and downstream walls are curved in a direction of film cooling injection.

* * * * *